US009953569B2

(12) United States Patent
Mu et al.

(10) Patent No.: US 9,953,569 B2
(45) Date of Patent: Apr. 24, 2018

(54) PIXEL CIRCUIT, ORGANIC ELECTROLUMINESCENT DISPLAY PANEL, DISPLAY APPARATUS AND DRIVING METHOD THEREOF

(71) Applicants: Boe Technology Group Co., Ltd., Beijing (CN); Hefei Xinsheng Optoelectronics Technology Co., Ltd., Anhui (CN)

(72) Inventors: Suzhen Mu, Beijing (CN); Zuquan Hu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 186 days.

(21) Appl. No.: 14/778,150

(22) PCT Filed: Feb. 10, 2015

(86) PCT No.: PCT/CN2015/072623
§ 371 (c)(1),
(2) Date: Sep. 18, 2015

(87) PCT Pub. No.: WO2016/074359
PCT Pub. Date: May 19, 2016

(65) Prior Publication Data

US 2016/0284280 A1 Sep. 29, 2016

(30) Foreign Application Priority Data

Nov. 13, 2014 (CN) ..... 2014 1 0640340

(51) Int. Cl.
*G09G 3/3233* (2016.01)
*G09G 3/3225* (2016.01)
*G09G 3/3258* (2016.01)

(52) U.S. Cl.
CPC ..... *G09G 3/3233* (2013.01); *G09G 3/3225* (2013.01); *G09G 3/3258* (2013.01);
(Continued)

(58) Field of Classification Search
CPC ..... G09G 3/32–3/3291
See application file for complete search history.

(56) References Cited

U.S. PATENT DOCUMENTS 7,329,849 B2 * 2/2008 Kasai ..... G09G 3/3233 250/208.1
7,528,809 B2 * 5/2009 Sim ..... G09G 3/3233 315/169.3

(Continued)

FOREIGN PATENT DOCUMENTS

CN 101075407 11/2007
CN 101118723 2/2008

(Continued)

OTHER PUBLICATIONS

International Search Report and Written Opinion from PCT/CN15/072623 dated Jul. 29, 2015.

(Continued)

*Primary Examiner* — Patrick F Marinelli
(74) *Attorney, Agent, or Firm* — Calfee, Halter & Griswold LLP

(57) ABSTRACT

The present invention discloses a pixel circuit, an organic electroluminescent display panel, a display apparatus and a driving method thereof. The pixel circuit performs initialization on a first node and a third node in an initialization phase, performs compensation on a threshold voltage of a drive module for the first node in a compensation phase, and performs data writing on the first node in a data writing phase.

20 Claims, 6 Drawing Sheets

(52) U.S. Cl.
CPC ..... *G09G 2300/0439* (2013.01); *G09G 2300/0819* (2013.01); *G09G 2300/0842* (2013.01); *G09G 2300/0861* (2013.01); *G09G 2300/0866* (2013.01); *G09G 2310/0251* (2013.01); *G09G 2310/08* (2013.01); *G09G 2320/043* (2013.01); *G09G 2320/045* (2013.01); *G09G 2320/0626* (2013.01)

(56) References Cited

U.S. PATENT DOCUMENTS 7,916,102 B2 * 3/2011 Chung ..... G09G 3/3233 345/76
8,305,308 B2 * 11/2012 Ono ..... G09G 3/325 345/76
8,537,077 B2 * 9/2013 Lee ..... G09G 3/3233 315/169.3
8,604,705 B2 * 12/2013 Ko ..... G09G 3/3233 315/169.1
8,810,485 B2 * 8/2014 Lee ..... G09G 3/3233 315/169.3
8,878,751 B2 * 11/2014 Chung ..... G09G 3/3233 345/76
9,018,842 B2 * 4/2015 Tan ..... G09G 3/3233 315/169.3
9,095,031 B2 * 7/2015 Tan ..... H05B 33/0896
9,111,893 B2 * 8/2015 Ebisuno ..... G09G 3/3233
9,230,479 B2 * 1/2016 Tan ..... G09G 3/3233
9,299,290 B2 * 3/2016 Ono ..... G09G 3/3258
9,305,492 B2 * 4/2016 Takahama ..... G09G 3/3291
9,349,318 B2 * 5/2016 Jung ..... G09G 3/3233
9,349,319 B2 * 5/2016 Wu ..... G09G 3/3233
9,384,700 B2 * 7/2016 Chen ..... G09G 3/3233
9,454,932 B2 * 9/2016 Ono ..... G09G 3/3233
9,779,662 B1 * 10/2017 Zhang ..... G09G 3/3233
2004/0207654 A1 * 10/2004 Hasuike ..... G06F 17/30905 345/698
2006/0055336 A1 * 3/2006 Jeong ..... G09G 3/3233 315/169.3
2006/0066251 A1 * 3/2006 Sim ..... G09G 3/3233 315/169.3
2006/0209094 A1 * 9/2006 Usuda ..... G06F 3/0485 345/684
2006/0231740 A1 * 10/2006 Kasai ..... G09G 3/3233 250/214.1
2008/0035931 A1 2/2008 Kwak et al.
2010/0141644 A1 * 6/2010 Lee ..... G09G 3/3233 345/214
2010/0201673 A1 8/2010 Kim et al.
2010/0220038 A1 * 9/2010 Chung ..... G09G 3/3233 345/76
2011/0157126 A1 * 6/2011 Chung ..... G09G 3/3233 345/211
2011/0164016 A1 * 7/2011 Kang ..... G09G 3/3233 345/211
2011/0164024 A1 * 7/2011 Ono ..... G09G 3/3233 345/212
2011/0227889 A1 * 9/2011 Choi ..... G09G 3/3233 345/209
2011/0248981 A1 * 10/2011 Yoshida ..... G09G 3/325 345/211
2011/0285760 A1 * 11/2011 Ono ..... G09G 3/3233 345/690
2012/0038612 A1 * 2/2012 Chung ..... G09G 3/3233 345/211
2012/0176426 A1 * 7/2012 Ono ..... G09G 3/325 345/691
2012/0200611 A1 * 8/2012 Matsui ..... G09G 3/3233 345/690
2013/0043796 A1 * 2/2013 Ko ..... G09G 3/3233 315/151
2013/0106307 A1 * 5/2013 Tan ..... H05B 33/0896 315/291
2013/0113779 A1 5/2013 Yoon et al.
2013/0307840 A1 * 11/2013 Lee ..... G09G 3/3233 345/212
2014/0071112 A1 * 3/2014 Han ..... H04N 13/0438 345/212
2014/0111562 A1 * 4/2014 Wu ..... G09G 3/3233 345/690
2014/0125713 A1 * 5/2014 Ryu ..... G09G 3/3233 345/690
2014/0168127 A1 * 6/2014 Yang ..... G06F 3/0412 345/173
2014/0168290 A1 * 6/2014 Yang ..... G09G 3/3233 345/691
2014/0175992 A1 * 6/2014 Yang ..... G09G 3/3233 315/172
2014/0191669 A1 * 7/2014 Tan ..... G09G 3/3233 315/172
2014/0313241 A1 * 10/2014 Ono ..... G09G 3/3233 345/691
2014/0333512 A1 * 11/2014 In ..... G09G 3/3233 345/76
2015/0053953 A1 * 2/2015 Ebisuno ..... G09G 3/3233 257/40
2015/0103037 A1 * 4/2015 Wu ..... G09G 3/3233 345/174
2015/0213757 A1 * 7/2015 Takahama ..... G09G 3/3266 345/691
2015/0302798 A1 * 10/2015 Tan ..... G09G 3/3233 345/698
2015/0356924 A1 * 12/2015 Chen ..... G09G 3/3233 345/690
2016/0005359 A1 * 1/2016 Kwon ..... G09G 3/3266 345/213
2016/0035276 A1 * 2/2016 Yin ..... G09G 3/3233 345/78
2016/0055791 A1 * 2/2016 Kishi ..... G09G 3/3241 345/212
2016/0071458 A1 * 3/2016 Tan ..... G09G 3/3233 345/212
2016/0125774 A1 * 5/2016 Hwang ..... G09G 3/003 345/215
2016/0125808 A1 * 5/2016 Hsu ..... G09G 3/3233 345/212
2016/0132171 A1 * 5/2016 Hu ..... G06F 3/0416 345/174
2016/0196783 A1 * 7/2016 Hu ..... G09G 3/3225 345/690
2016/0253014 A1 * 9/2016 Yang ..... G09G 3/32 345/174
2016/0260377 A1 * 9/2016 Hu ..... G09G 3/3233
2016/0284280 A1 * 9/2016 Mu ..... G09G 3/3258
2016/0351125 A1 * 12/2016 Zhou ..... G09G 3/32
2016/0365032 A1 * 12/2016 Wu ..... G09G 3/3258
2017/0047010 A1 * 2/2017 Chen ..... G09G 3/3258
2017/0169761 A1 * 6/2017 Ma ..... G09G 3/3233
2017/0330505 A1 * 11/2017 Han ..... G09G 3/325

FOREIGN PATENT DOCUMENTS

CN 101996579 3/2011
CN 102930813 2/2013
CN 103325343 9/2013
CN 203300194 11/2013
CN 103531151 1/2014
CN 104318897 1/2015
CN 204130142 1/2015
JP 2008040478 A 2/2008
KR 100712678 B1 5/2007
KR 20090119810 11/2009
KR 20100107654 10/2010
KR 101375040 B1 3/2014

(56) References Cited

FOREIGN PATENT DOCUMENTS

| | | | | |
|---|---|---|---|---|
| KR | 101549284 B1 | 9/2015 | | |
| WO | WO 2013078931 A1 * | 6/2013 | ..... | G09G 3/3233 |

OTHER PUBLICATIONS

Office Action from Korea Application No. 1020157028285 dated Jan. 4, 2017.
Office Action from China Application No. 201410640340.0 dated Dec. 5, 2016.
Office action from Chinese Application No. 201410640340.0 dated Mar. 3, 2016.
Office action from Chinese Application No. 201410640340.0 dated Jul. 12, 2016.
Notice of Grant of Patent for Korean Patent Application No. 10-2015-7028285 dated Jul. 28, 2017.

* cited by examiner

PIXEL CIRCUIT, ORGANIC ELECTROLUMINESCENT DISPLAY PANEL, DISPLAY APPARATUS AND DRIVING METHOD THEREOF

REFERENCE TO RELATED APPLICATIONS

This application is the U.S. national phase entry of PCT/CN2015/072623, with an international filing date of Feb. 10, 2015, which claims the priority to Chinese Patent Application No. 201410640340.0, filed on Nov. 13, 2014, which is herein incorporated by reference in its entirely as a part of this application.

TECHNICAL FIELD

The present invention relates to the technical field of display, and particularly relates to a pixel circuit, an organic electroluminescent display panel, a display apparatus and a driving method thereof.

BACKGROUND ART

As the display technique has progressed, more and more active matrix organic light emitting diode (AMOLED) display panels are going to enter the market. Compared with a conventional thin film transistor liquid crystal display (TFT LCD) panel, the active matrix organic light emitting diode display panel has the advantages of low energy consumption, low production cost, self light emission, wide viewing angle, high response speed and the like. At present, the active matrix organic light emitting diode display panel has already started replacing a conventional LCD display screen gradually in the fields of cellphone, PDA, digital camera and the like. Unlike a TFT LCD, which controls brightness with a stable voltage, AMOLED is current-driven and needs a stable current to control light emission.

As shown in FIG. 1, an existing pixel circuit driving an OLED to emit light comprises a drive transistor M1, a switch transistor M2, a storage capacitor C, and a light emitting device OLED, wherein a gate electrode of the drive transistor M1 is connected with a drain electrode of the switch transistor M2 and one end of the storage capacitor C, a source electrode thereof is connected with a high-voltage signal end VDD, and a drain electrode thereof is connected with the other end of the storage capacitor and one end of the light emitting device OLED. A gate electrode of the switch transistor M2 is connected with a scan signal end Gate, and a source electrode thereof is connected with a data signal end Data. The other end of the light emitting device OLED is connected with a low-voltage signal end VSS. When the drive transistor M1 drives the light emitting device OLED to emit light, a driving current is controlled jointly by the high-voltage signal end VDD, the data signal end Data and the drive transistor M1. Because a luminous brightness of the OLED is quite sensitive to a change in the driving current thereof, and the drive transistor M1 may not be made completely consistent in a fabrication process. In addition, due to reasons such as a process flow and device aging, as well as a temperature change in a working process, a threshold voltage Vth of the drive transistor M1 in each pixel circuit is non-uniform, which causes a change to the current flowing through each pixel point OLED, such that a display brightness is non-uniform, thereby affecting a display effect of the whole image.

Accordingly, a problem to be solved by a person skilled in the art is how to eliminate the influence of the change in the threshold voltage of the drive transistor in the pixel circuit on the luminous brightness of the light emitting device, to ensure the uniformity of the current for driving the light emitting device OLED so as to ensure the quality of a display frame.

SUMMARY OF THE INVENTION

Embodiments of the present invention provide a pixel circuit, an organic electroluminescent display panel, a display apparatus, and a driving method thereof, which are used for solving a problem that a luminous brightness of a light emitting device is affected by a change in a threshold voltage of a drive transistor in a pixel circuit in the prior art.

An embodiment of the present invention provides a pixel circuit, comprising an initialization module, a charging control module, a drive module, and a light emitting module with a light emitting device, wherein a control end of the drive module is connected with a first node, an input end thereof is connected with a second node, and an output end thereof is connected with an input end of the light emitting module. A control end of the charging control module is connected with a scan signal end, an input end thereof is connected with a data signal end, and an output end thereof is connected with a third node. The initialization module is connected with the first node, the second node, the third node, a first reference signal end, a first signal control end and the scan signal end. A first control end of the light emitting module is connected with a second signal control end, a second control end thereof is connected with a light emission signal control end, and an output end thereof is connected with a second reference signal end.

In an initialization phase, the initialization module is configured to initialize the first node under a control of the scan signal end, and the charging control module is configured to initialize the third node under the control of the scan signal end. In a compensation phase, the light emitting module is configured to realize a conduction between an output end of the drive module and the second reference signal end under a control of the second signal control end, and the initialization module is configured to compensate a threshold voltage of the drive module for the first node under a control of the first signal control end and the scan signal end.

In a data writing phase, the charging control module is configured to perform data writing on the first node through the initialization module under the control of the scan signal end.

In one possible implementation, in the above pixel circuit provided by the embodiment of the present invention, in a light emitting phase, the initialization module is configured to realize a conduction between the first reference signal end and an input end of the drive module under a control of the first signal control end, such that the drive module drives the light emitting device in the light emitting module to emit light.

In one possible implementation, in the above pixel circuit provided by the embodiment of the present invention, the drive module particularly comprises a drive transistor; wherein a gate electrode of the drive transistor is connected with the first node, a source electrode thereof is connected with the second node, and a drain electrode thereof is connected with an input end of the light emitting module.

In one possible implementation, in the above pixel circuit provided by the embodiment of the present invention, the initialization module particularly comprises a first switch transistor, a second switch transistor and a storage capacitor; wherein a gate electrode of the first switch transistor is connected with the scan signal end, a source electrode thereof is connected with the first reference signal end, and a drain electrode thereof is connected with the first node;

a gate electrode of the second switch transistor is connected with the first signal control end, a source electrode thereof is connected with the first reference signal end, and a drain electrode thereof is connected with the second node; and the storage capacitor is connected between the first node and the third node.

In one possible implementation, in the above pixel circuit provided by the embodiment of the present invention, the charging control module particularly comprises a third switch transistor; wherein a gate electrode of the third switch transistor is connected with the scan signal end, a source electrode thereof is connected with the data signal end, and a drain electrode thereof is connected with the third node.

In one possible implementation, in the above pixel circuit provided by the embodiment of the present invention, the first switch transistor and the third switch transistor are both P-type transistors, or are both N-type transistors.

In one possible implementation, in the above pixel circuit provided by the embodiment of the present invention, the light emitting module particularly comprises a light emitting device, a fourth switch transistor and a fifth switch transistor, wherein a gate electrode of the fourth switch transistor is connected with the second signal control end, a source electrode thereof is connected with an output end of the drive module and a source electrode of the fifth switch transistor, and a drain electrode thereof is connected with an output end of the light emitting device and the second reference signal end; and a gate electrode of the fifth switch transistor is connected with the light emission signal control end, and a drain electrode thereof is connected with an input end of the light emitting device.

An embodiment of the present invention provides an organic electroluminescent display panel, comprising the above pixel circuit provided by the embodiment of the present invention.

An embodiment of the present invention provides a display apparatus, comprising the organic electroluminescent display panel provided by the embodiment of the present invention.

An embodiment of the present invention provides a driving method of a pixel circuit, wherein the pixel circuit comprises an initialization module, a charging control module, a drive module, and a light emitting module with a light emitting device, wherein a control end of the drive module is connected with a first node, an input end thereof is connected with a second node, and an output end thereof is connected with an input end of the light emitting module. A control end of the charging control module is connected with a scan signal end, an input end thereof is connected with a data signal end, and an output end thereof is connected with a third node; the initialization module is connected with the first node, the second node, the third node, a first reference signal end, a first signal control end and the scan signal end. A first control end of the light emitting module is connected with a second signal control end, a second control end thereof is connected with a light emission signal control end, and an output end thereof is connected with a second reference signal end.

The method may comprise the following steps:

In an initialization phase, initializing the first node by the initialization module under a control of the scan signal end, and initializing the third node by the charging control module under the control of the scan signal end.

In a compensation phase, realizing a conduction between an output end of the drive module and the second reference signal end by the light emitting module under a control of the second signal control end, and compensating a threshold voltage of the drive module for the first node by the initialization module under the control of the first signal control end and the scan signal end.

In a data writing phase, performing data writing on the first node by the charging control module through the initialization module under the control of the scan signal end.

Advantageous effects of the embodiments of the present invention are as follows.

The embodiments of the present invention provide a pixel circuit, an organic electroluminescent display panel, a display apparatus and a driving method thereof. The pixel circuit comprises an initialization module, a charging control module, a drive module, and a light emitting module with a light emitting device. In the initialization phase, the initialization module initializes the first node, and the charging control module initializes the third node. In the compensation phase, the light emitting module realizes a conduction between the output end of the drive module and the second reference signal end, and the initialization module compensates the threshold voltage of the drive module for the first node. In the data writing phase, the charging control module performs data writing on the first node through the initialization module. In the light emitting phase, the initialization module realizes a conduction between the first reference signal end and the input end of the drive module, such that the drive module drives the light emitting device in the light emitting module to emit light, thereby realizing a normal light emitting function of the light emitting device. In this way, compared with a pixel circuit in the prior art, the pixel circuit provided by the embodiment of the present invention can perform initialization on the control end of the drive module in the initialization phase, perform compensation on the threshold voltage of the drive module in the compensation phase, and perform data writing on the drive module in the data writing phase, thereby preventing the change in the threshold voltage of the drive module from affecting the luminous brightness of the light emitting device, improving the uniformity of the luminous brightness of the light emitting device, and further ensuring the quality of a display frame.

DETAILED DESCRIPTION OF THE INVENTION

The detailed description of a pixel circuit, an organic electroluminescent display panel, a display apparatus and a driving method thereof provided by embodiments of the present invention will be illustrated in detail with reference to the accompanying drawings.

Figure 1:
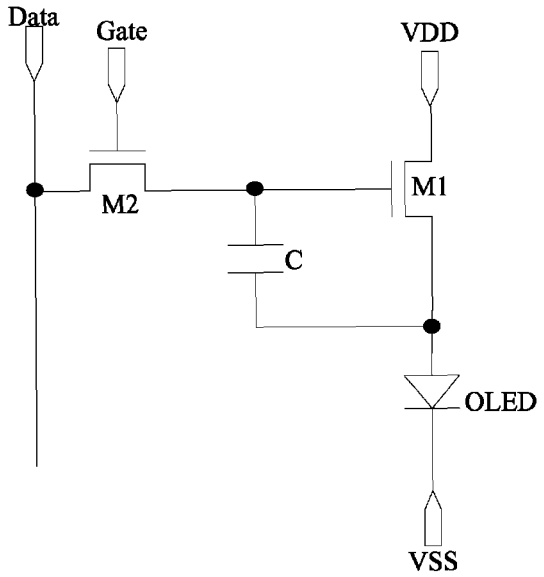
FIG. 1 is a schematic structural view of a pixel circuit in the prior art.
Figure 2:
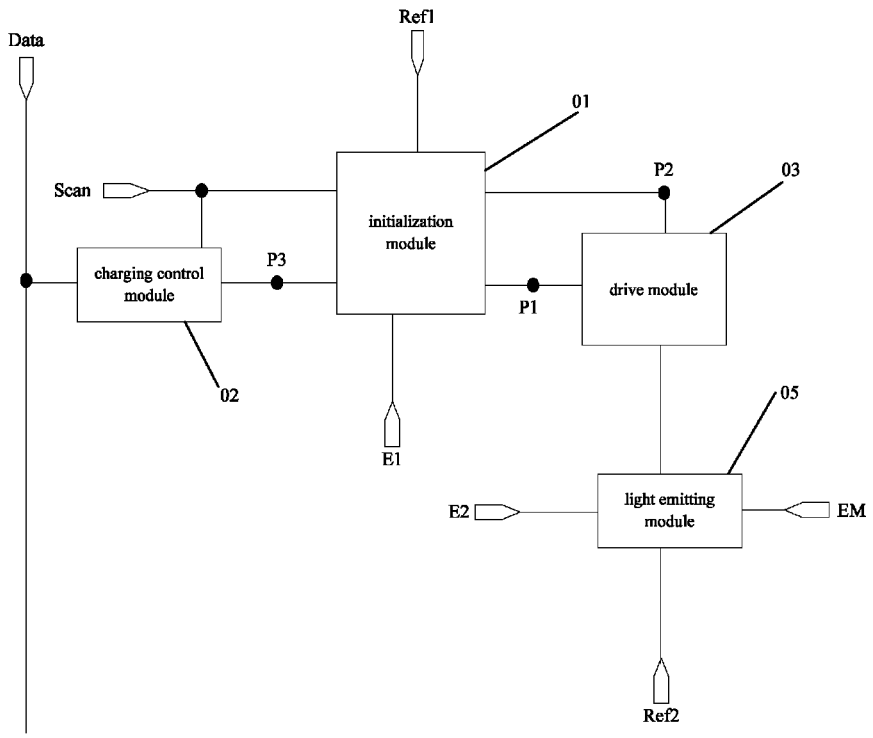
FIG. 2 is a schematic structural view of a pixel circuit provided by an embodiment of the present invention.

An embodiment of the present invention provides a pixel circuit, as shown in FIG. 2, comprising an initialization module 01, a charging control module 02, a drive module 03, and a light emitting module 05 with a light emitting device 04, wherein a control end of the drive module 03 is connected with a first node P1, an input end thereof is connected with a second node P2, and an output end thereof is connected with an input end of the light emitting module 05. A control end of the charging control module 02 is connected with a scan signal end Scan, an input end thereof is connected with a data signal end Data, and an output end thereof is connected with a third node P3. The initialization module 01 is connected with the first node P1, the second node P2, the third node P3, a first reference signal end Ref1, a first signal control end E1 and the scan signal end Scan. A first control end of the light emitting module 05 is connected with a second signal control end E2, a second control end thereof is connected with a light emission signal control end EM, and an output end thereof is connected with a second reference signal end Ref2.

In an initialization phase, the initialization module 01 is configured to initialize the first node P1 under a control of the scan signal end Scan, and the charging control module 02 is configured to initialize the third node P3 under the control of the scan signal end Scan.

In a compensation phase, the light emitting module 05 is configured to realize a conduction between an output end of the drive module 03 and the second reference signal end Ref2 under a control of the second signal control end E2, and the initialization module 01 is configured to compensate a threshold voltage of the drive module 03 for the first node P1 under a control of the first signal control end E1 and the scan signal end Scan.

In a data writing phase, the charging control module 02 is configured to perform data writing on the first node P1 through the initialization module 01 under the control of the scan signal end Scan.

In a light emitting phase, the initialization module 01 is configured to realize a conduction between the first reference signal end Ref1 and the input end of the drive module 03 under the control of the first signal control end E1, such that the drive module 03 drives the light emitting device 04 in the light emitting module 05 to emit light.

In the above pixel circuit provided by the embodiment of the present invention, in the initialization phase, the initialization module 01 initializes the first node P1, and the charging control module 02 initializes the third node P3. In the compensation phase, the light emitting module 05 realizes a conduction between the output end of the drive module 03 and the second reference signal end Ref2, and the initialization module 01 compensates the threshold voltage of the drive module 03 for the first node P1. In the data writing phase, the charging control module 02 performs data writing on the first node P1 through the initialization module 01. In the light emitting phase, the initialization module 01 realizes a conduction between the first reference signal end Ref1 and the input end of the drive module 03, such that the drive module 03 drives the light emitting device 04 in the light emitting module 05 to emit light, thereby realizing a normal light emitting function of the light emitting device 04. In this way, compared with a pixel circuit in the prior art, the pixel circuit provided by the embodiment of the present invention can perform initialization on the control end of the drive module 03 in the initialization phase, perform compensation on the threshold voltage of the drive module 03 in the compensation phase, and perform data writing on the drive module 03 in the data writing phase, thereby preventing a change in the threshold voltage of the drive module 03 from affecting a luminous brightness of the light emitting device 04, thus improving the uniformity of the luminous brightness of the light emitting device 04, and further ensuring the quality of a display frame.

Figure 3A:
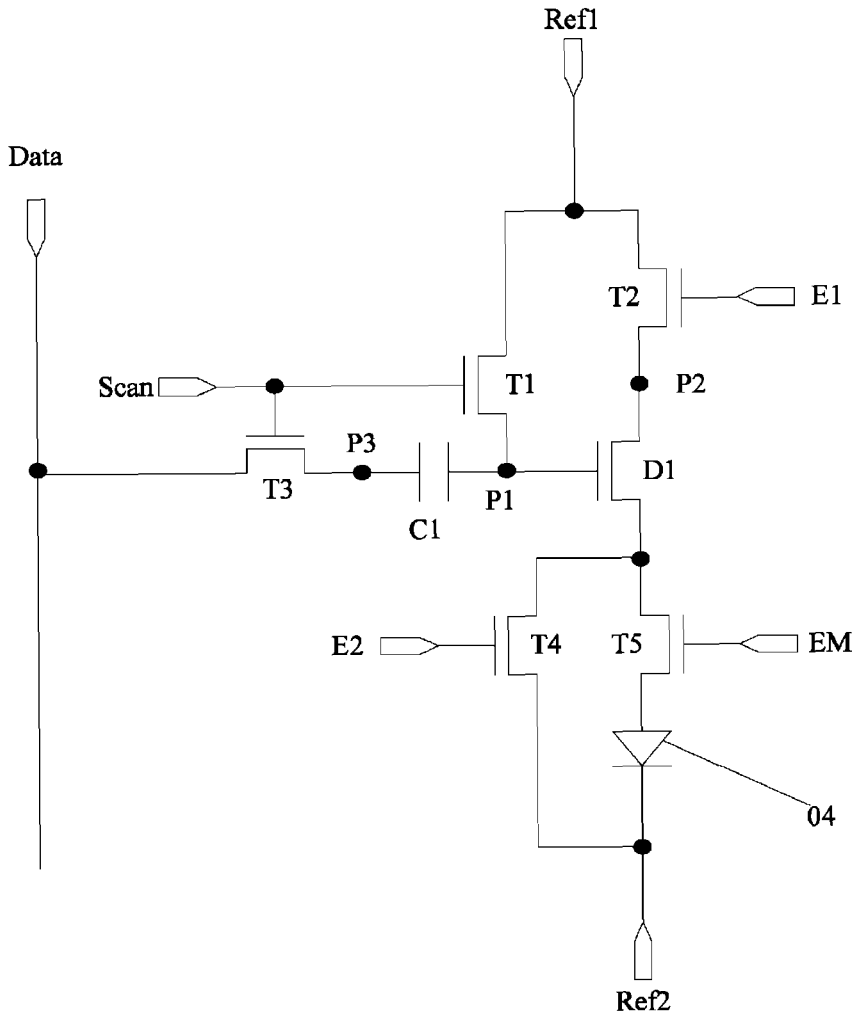
FIG. 3*a* and FIG. 3*b* are respectively schematic specific structural views of a pixel circuit provided by an embodiment of the present invention.
Figure 3B:
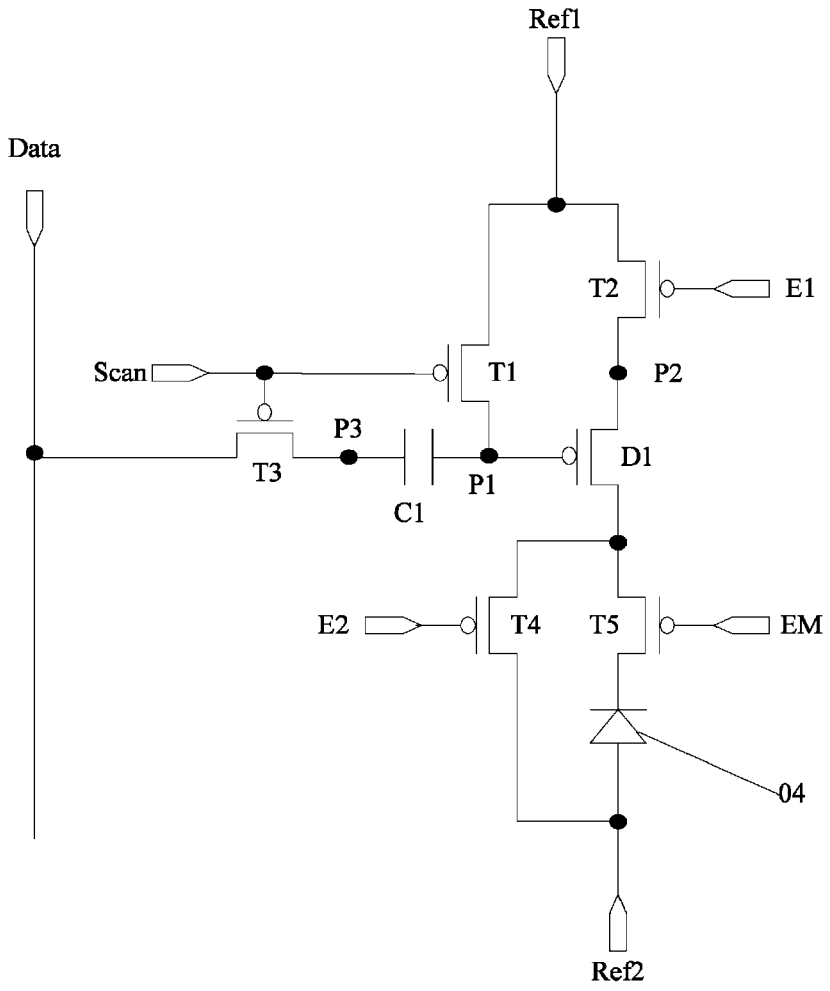

In a specific implementation, in the above pixel circuit provided by the embodiment of the present invention, as shown in FIG. 3*a* and FIG. 3*b* and the drive module 03 may particularly comprise a drive transistor D1. A gate electrode of the drive transistor D1 is connected with the first node P1, a source electrode thereof is connected with the second node P2, and a drain electrode thereof is connected with an input end of the light emitting module 05.

Particularly, in the above pixel circuit provided by the embodiment of the present invention, as shown in FIG. 3*a*, the drive transistor D1 may be an N-type transistor. As shown in FIG. 3*b*, the drive transistor D1 may also be a P-type transistor, which will not be defined here. In an initialization time period, the initialization module 01 realizes a conduction between the first reference signal end Ref1 and the first node P1 under the control of the scan signal end Scan to initialize the first node P1 (i.e., the gate electrode of the drive transistor D1), such that the drive transistor D1 is in a saturated on state. In the compensation phase, the initialization module 01 and the drive transistor D1 form a discharge loop to discharge a voltage for the first node P1 to a threshold voltage Vth of the drive transistor D1, that is, the compensation for the threshold voltage of the drive transistor D1 is realized. In the data writing phase, the charging control module 02 writes a data signal input by the data signal end Data into the first node P1 through the initialization module 01 (i.e., performs data writing on the gate electrode of the drive transistor D1). In the light emitting phase, the initialization module 01 realizes a conduction between the first reference signal end Ref1 and the source electrode of the drive transistor D1, such that the drive transistor D1 drives the light emitting device 04 in the light emitting module 05 to emit light by using a voltage signal input by the first reference signal end Ref1 as a driving voltage.

In a specific implementation, in the above pixel circuit provided by the embodiment of the present invention, as shown in FIG. 3*a* and FIG. 3*b*, the initialization module 01 may particularly comprise a first switch transistor T1, a second switch transistor T2 and a storage capacitor C1. A gate electrode of the first switch transistor T1 is connected with the scan signal end Scan, a source electrode thereof is connected with the first reference signal end Ref1, and a drain electrode thereof is connected with the first node P1. A gate electrode of the second switch transistor T2 is connected with the first signal control end E1, a source electrode thereof is connected with the first reference signal end Ref1, and a drain electrode thereof is connected with the second node P2; and the storage capacitor C1 is connected between the first node P1 and the third node P3.

Particularly, in the above pixel circuit provided by the embodiment of the present invention, as shown in FIG. 3*a*, the first switch transistor T1 and the second switch transistor T2 may be N-type transistors. As shown in FIG. 3*b*, the first switch transistor T1 and the second switch transistor T2 may be P-type transistors, which will not be defined here. In the initialization phase, the first switch transistor T1 is conducted under the control of the scan signal end Scan, the conducted first switch transistor T1 realizes a conduction between the first reference signal end Ref1 and the first node P1 to initialize the first node P1. In the compensation phase, the first switch transistor T1 and the second switch transistor T2 are conducted respectively under the control of the scan signal end Scan and the first signal control end E1, the first switch transistor T1 and the second switch transistor T2 which are conducted form a discharge loop with the drive transistor D1 to discharge a voltage for the first node P1 to a threshold voltage Vth of the drive transistor. In the light emitting phase, the second switch transistor T2 is conducted under the control of the first signal control end E1, the conducted second switch transistor T2 realizes a conduction between the first reference signal end Ref1 and the source electrode of the drive transistor D1, such that the drive transistor D1 drives the light emitting device 04 in the light emitting module 05 to emit light by using a voltage signal input by the first reference signal end Ref1 as a driving voltage.

In a specific implementation, in the above pixel circuit provided by the embodiment of the present invention, as shown in FIG. 3*a* and FIG. 3*b*, the charging control module 02 may particularly comprise a third switch transistor T3. A gate electrode of the third switch transistor T3 is connected with the scan signal end Scan, a source electrode thereof is connected with the data signal end Data, and a drain electrode thereof is connected with the third node P3.

Particularly, in the above pixel circuit provided by the embodiment of the present invention, as shown in FIG. 3*a*, the third switch transistor T3 may be an N-type transistor. As shown in FIG. 3*b*, the third switch transistor T3 may be a P-type transistor, which will not be defined here. In the initialization phase, the third switch transistor T3 is conducted under the control of the scan signal end Scan, the conducted third switch transistor T3 realizes a conduction between the data signal end Data and the third node P3 to initialize the third node P3 by a voltage signal input by the data signal end Data. In the compensation phase, the similarly conducted third switch transistor T3 keeps a voltage for the third node P3 constant; and in the data writing phase, the similarly conducted third switch transistor T3 writes a data signal input by the data signal end Data into the third node P3.

In a specific implementation, in the above pixel circuit provided by the embodiment of the present invention, because the first switch transistor T1 and the third switch transistor T3 employ the same scan signal end Scan as a control end, in order to enable the two transistors to complete respective functions in different phases under the control of the same scan signal end Scan, the first switch transistor T1 and the third switch transistor T3 are set to be transistors of the same type. As shown in FIG. 3*a*, the first switch transistor T1 and the third switch transistor T3 may be both N-type transistors; as shown in FIG. 3*b*, the first switch transistor T1 and the third switch transistor T3 may also be both P-type transistors.

In a specific implementation, in the above pixel circuit provided by the embodiment of the present invention, as shown in FIG. 3*a* and FIG. 3*b*, the light emitting module 05 particularly comprises a light emitting device 04, a fourth switch transistor T4 and a fifth switch transistor T5. A gate electrode of the fourth switch transistor T4 is connected with the second signal control end E2, a source electrode thereof is connected with an output end of the drive module 03 and a source electrode of the fifth switch transistor T5, and a drain electrode thereof is connected with an output end of the light emitting device 04 and the second reference signal end Ref2. A gate electrode of the fifth switch transistor T5 is connected with the light emission signal control end EM, and a drain electrode thereof is connected with an input end of the light emitting device 04.

Particularly, in the above pixel circuit provided by the embodiment of the present invention, as shown in FIG. 3*a*, the fourth switch transistor T4 and the fifth switch transistor T5 may be N-type transistors. As shown in FIG. 3*b*, the fourth switch transistor T4 and the fifth switch transistor T5 may be P-type transistors, which will not be defined here. In the compensation phase, the fourth switch transistor T4 is conducted under the control of the second signal control end E2, the conducted fourth switch transistor T4 realizes a conduction between the output end of the drive module 03 and the second reference signal end Ref2. In the data writing phase, the similarly conducted fourth switch transistor T4 keeps a voltage for the output end of the drive module 03 constant. In the light emitting phase, the fifth switch transistor T5 is conducted under a control of the light emission signal control end EM, and the conducted fifth switch transistor T5 realizes a conduction between the output end of the drive module 03 and the input end of the light emitting device 04, such that the driving module 03 drives the light emitting device 04 to emit light.

It should be noted that, the switch transistors and the drive transistors mentioned in the embodiment of the present invention may be thin film transistors (TFT), and may also be metal oxide semiconductor (MOS) field effect transistors, which will not be defined here. In a specific implementation, source electrodes and drain electrodes of these transistors may be interchanged without being particularly distinguished. The thin film transistor is used as an example when particular embodiments are described.

Moreover, the switch transistors and the drive transistors mentioned in the embodiment of the present invention may all employ P-type transistors or all employ N-type transistors. In this way, a fabricating process for the pixel circuit may be simplified.

A working process of the pixel circuit provided by the embodiment of the present invention is described in detail below in conjunction with a structure and a timing sequence of a pixel circuit provided by the embodiment of the present invention. The switch transistors and the drive transistors of the pixel circuit in the first embodiment are all designed to employ N-type transistors; and the switch transistors and the drive transistors of the pixel circuit in the second embodiment are all designed to employ P-type transistors.

First Embodiment

Figure 4A:
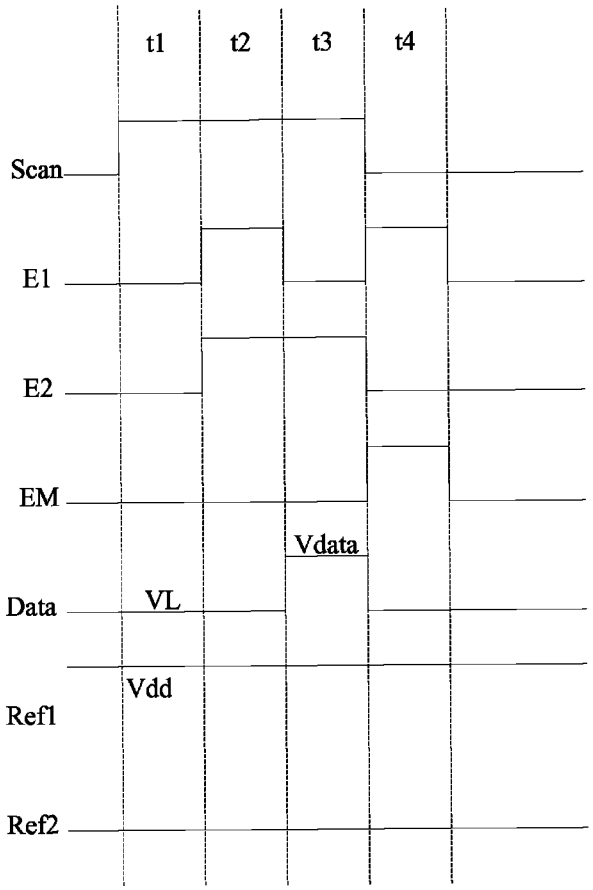
FIG. 4*a* and FIG. 4*b* are respectively schematic timing sequence views of an embodiment I and an embodiment II provided by an embodiment of the present invention.

The working process of the pixel circuit provided by the embodiment of the present invention is described in detail below in conjunction with the pixel circuit as shown in FIG. 3*a* and an input-output timing sequence view for FIG. 3*a* as shown in FIG. 4*a*. Particularly, four phases t1-t4 in the input-output timing sequence view as shown in FIG. 4*a* are selected. In the following description, 1 represents a high-level signal, and 0 represents a low-level signal.

In the t1 phase, Scan=1, E1=0, E2=0, EM=0, Data=VL, Ref1=Vdd, and Ref2=0. Because Scan=1, the first switch transistor T1 and the third switch transistor T3 are conducted. Because E1=0, E2=0 and EM=0, the second switch transistor T2, the fourth switch transistor T4 and the fifth switch transistor T5 are cut off. The conducted first switch transistor T1 realizes a conduction between the first reference signal end Ref1 and the first node P1 to initialize the first node P, that is, to initialize the gate electrode of the drive transistor D1. At that time, a voltage for the first node P1, that is, a voltage for the right end of the storage capacitor C1, is Vdd; the conducted third switch transistor T3 transmits a voltage signal VL input by the data signal end Data to the third node P3. Further, at that time, a voltage for the third node, that is, a voltage for the left end of the storage capacitor C1, is VL, in this phase, a voltage for the gate electrode of the drive transistor D1 is initialized to Vdd, so that the drive transistor D1 is in a saturated on state. The t1 phase is an initialization phase.

In the t2 phase, Scan=1, E1=1, E2=1, EM=0, Data=VL, Ref1=Vdd and Ref2=0. Because Scan=1, E1=1 and E2=1, the first switch transistor T1, the second switch transistor T2, the third switch transistor T3 and the fourth switch transistor T4 are conducted. Further, because EM=0, the fifth switch transistor T5 is cut off. The first switch transistor T1 and the second switch transistor T2 which are conducted form a discharge loop with the drive transistor D1 to discharge a voltage for the first node P1 to a threshold voltage Vth of the drive transistor D1, that is, at that time, a voltage for the right end of the storage capacitor C1 is Vth, and the drive transistor D1 is in a critical on state. The conducted third switch transistor T3 keeps a voltage for the third node P3 at VL, that is, the voltage for the left end of the storage capacitor C1 is still VL, at that time, a voltage difference across two ends of the storage capacitor C1 is VL-Vth. The conducted fourth switch transistor T4 realizes a conduction between the drain electrode of the drive transistor D1 and the second reference signal end Ref2. The t2 phase is a compensation phase.

In the t3 phase, Scan=1, E1=0, E2=1, EM=0, Data=Vdata, Ref1=Vdd and Ref2=0. Because Scan=1 and E2=1, the first switch transistor T1, the third switch transistor T3 and the fourth switch transistor T4 are conducted. Because E1=0 and EM=0, the second switch transistor T2 and the fifth switch transistor T5 are cut off. The conducted first switch transistor T1 realizes a conduction between the first reference signal end Ref1 and the gate electrode of the drive transistor D1, and the conducted fourth switch transistor T4 realizes a conduction between the drain electrode of the transistor D1 and the second reference signal end Ref2. The conducted third switch transistor T3 transmits a data signal Vdata input by the data signal end Data to the third node P3, thus the voltage for the left end of the storage capacitor C1 is regulated to Vdata. Because the voltage difference across two ends of the storage capacitor C1 is kept at VL−Vth as the last phase, the voltage for the right end of the storage capacitor C1, that is, a voltage for the first node P1, is Vdata−VL+Vth. The t3 phase is a data writing phase.

In the t4 phase, Scan=0, E1=1, E2=0, EM=1, Data=VL, Ref1=Vdd and Ref2=0. Because E1=1 and EM=1, the second switch transistor T2 and the fifth switch transistor T5 are conducted. Because Scan=0 and E2=0, the first switch transistor T1, the third switch transistor T3 and the fourth switch transistor T4 are cut off. The conducted second switch transistor T2 realizes a conduction between the first reference signal end Ref1 and the source electrode of the drive transistor D1, the conducted fifth switch transistor T5 realizes a conduction between the drain electrode of the drive transistor D1 and the input end of the light emitting device 04, such that the drive transistor D1 drives the light emitting device 04 to emit light by using a voltage signal input by the first reference signal end Ref1 as a driving voltage. As can be known from the last phase, the voltage for the gate electrode of the drive transistor D1 is Vdata−VL+Vth, thus a driving current for driving the light emitting device 04 to emit light is $I=K(Vgs-Vth)^2=K(Vdata-VL+Vth-Vth)^2=K(Vdata-VL)^2$, wherein Vgs is a voltage difference between the gate electrode and the source electrode of the drive transistor D1, K is a constant related to a process parameter and a geometric size of the drive transistor D1. The driving current for driving the light emitting device 04 to emit light is independent of the threshold voltage of the drive transistor D1, so that the influence of the change in the threshold voltage of the drive transistor D1 on the luminous brightness of the light emitting device 04 is eliminated, and the uniformity of the luminous brightness of the light emitting device 04 is improved. The t4 phase is a light emitting phase.

In a subsequent time period, the drive transistor D1 will be continuously in an on state to drive the light emitting device 04 to continuously emit light, until the next high-level signal of the scan signal end Scan arrives.

Second Embodiment

Figure 4B:
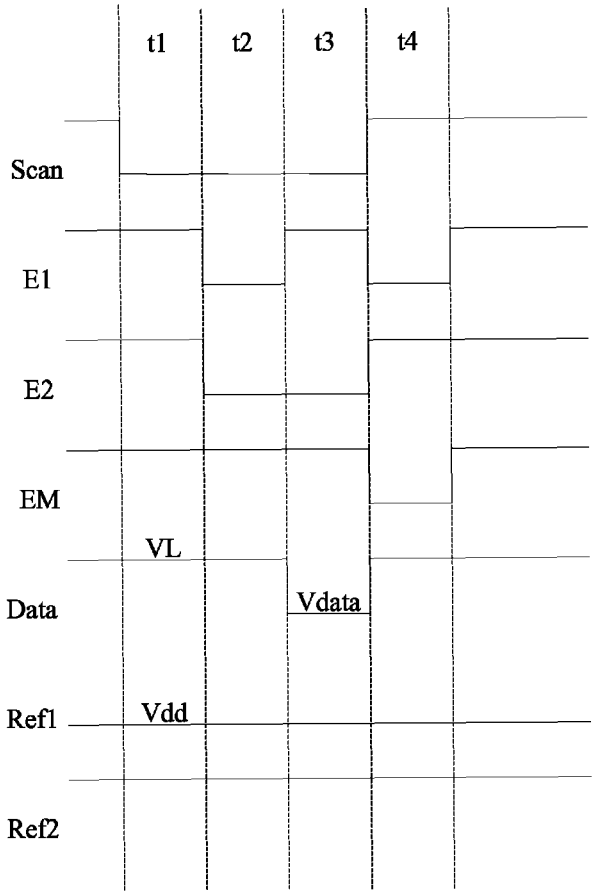

The working process of the pixel circuit provided by the embodiment of the present invention is described in detail below in conjunction with the pixel circuit as shown in FIG. 3*b* and an input-output timing sequence view for FIG. 3*b* as shown in FIG. 4*b*. Particularly, four phases t1-t4 in the input-output timing sequence view as shown in FIG. 4*b* are selected. In the following description, 1 represents a high-level signal, and 0 represents a low-level signal.

In the t1 phase, Scan=0, E1=1, E2=1, EM=1, Data=VL, Ref1=Vdd, and Ref2=1. Because Scan=0, the first switch transistor T1 and the third switch transistor T3 are conducted; and because E1=1, E2=1 and EM=1, the second switch transistor T2, the fourth switch transistor T4 and the fifth switch transistor T5 are cut off. The conducted first switch transistor T1 realizes a conduction between the first reference signal end Ref1 and the first node P1 to initialize the first node P, that is, to initialize the gate electrode of the drive transistor D1. At this phase, a voltage for the first node P1, that is, a voltage for the right end of the storage capacitor C1, is Vdd. The conducted third switch transistor T3 transmits a voltage signal VL input by the data signal end Data to the third node P3, at this phase, a voltage for the third node, this is, a voltage for the left end of the storage capacitor C1, is VL, in this phase, a voltage for the gate electrode of the drive transistor D1 is initialized to Vdd, so that the drive transistor D1 is in a saturated on state. The t1 phase is an initialization phase.

In the t2 phase, Scan=0, E1=0, E2=0, EM=1, Data=VL, Ref1=Vdd and Ref2=1. Because Scan=0, E1=0 and E2=0, the first switch transistor T1, the second switch transistor T2, the third switch transistor T3 and the fourth switch transistor T4 are conducted. Because EM=1, the fifth switch transistor T5 is cut off. The first switch transistor T1 and the second switch transistor T2 which are conducted form a discharge loop with the drive transistor D1 to discharge a voltage for the first node P1 to a threshold voltage Vth of the drive transistor D1, that is, at this phase, a voltage for the right end of the storage capacitor C1 is Vth, and at this phase, the drive transistor D1 is in a critical on state. The conducted third switch transistor T3 keeps a voltage for the third node P3 at VL, that is, the voltage for the left end of the storage capacitor C1 is still VL, at this phase, a voltage difference across two ends of the storage capacitor C1 is VL−Vth; the conducted fourth switch transistor T4 realizes a conduction between the drain electrode of the drive transistor D1 and the second reference signal end Ref2. The t2 phase is a compensation phase.

In the t3 phase, Scan=0, E1=1, E2=0, EM=1, Data=Vdata, Ref1=Vdd and Ref2=1. Because Scan=0 and E2=0, the first switch transistor T1, the third switch transistor T3 and the fourth switch transistor T4 are conducted. Because E1=1 and EM=1, the second switch transistor T2 and the fifth switch transistor T5 are cut off. The conducted first switch transistor T1 realizes a conduction between the first reference signal end Ref1 and the gate electrode of the drive transistor D1, the conducted fourth switch transistor T4 realizes a conduction between the drain electrode of the transistor D1 and the second reference signal end Ref2. The conducted third switch transistor T3 transmits a data signal Vdata input by the data signal end Data to the third node P3, thus the voltage for the left end of the storage capacitor C1 is regulated to Vdata. Because the voltage difference across two ends of the storage capacitor C1 is kept at VL−Vth as the last phase, the voltage for the right end of the storage capacitor C1, that is, a voltage for the first node P1, is Vdata−VL+Vth. The t3 phase is a data writing phase.

In the t4 phase, Scan=1, E1=0, E2=1, EM=0, Data=VL, Ref1=Vdd and Ref2=1. Because E1=0 and EM=0, the second switch transistor T2 and the fifth switch transistor T5 are conducted. Further, because Scan=1 and E2=1, the first switch transistor T1, the third switch transistor T3 and the fourth switch transistor T4 are cut off. The conducted second switch transistor T2 realizes a conduction between the first reference signal end Ref1 and the source electrode of the drive transistor D1. The conducted fifth switch transistor T5 realizes a conduction between the drain electrode of the drive transistor D1 and the input end of the light emitting device 04, such that the drive transistor D1 drives the light emitting device 04 to emit light by using a voltage signal input by the first reference signal end Ref1 as a driving voltage. As is known from the last phase, the voltage for the gate electrode of the drive transistor D1 is Vdata−VL+Vth, thus a driving current for driving the light emitting device 04 to emit light is $I=K(Vgs-Vth)^2=K(Vdata-VL+Vth-Vth)^2=K(Vdata-VL)^2$, wherein Vgs is a voltage difference between the gate electrode and the source electrode of the drive transistor D1, K is a constant related to a process parameter and a geometric size of the drive transistor D1. As is known, the driving current for driving the light emitting device 04 to emit light is independent of the threshold voltage of the drive transistor D1, so that the influence of the change in the threshold voltage of the drive transistor D1 on the luminous brightness of the light emitting device 04 is eliminated, and the uniformity of the luminous brightness of the light emitting device 04 is improved. The t4 phase is a light emitting phase.

In a subsequent time period, the drive transistor D1 will be continuously in an on state to drive the light emitting device 04 to continuously emit light, until the next low-level signal of the scan signal end Scan arrives.

Based on the same inventive concept, an embodiment of the present invention provides an organic electroluminescent display panel, comprising the above pixel circuit provided by the embodiment of the present invention. Because a principle for solving a problem by the organic electroluminescent display panel is similar to that by the pixel circuit, implementations for the organic electroluminescent display panel may refer to that for the pixel circuit, and repeated parts will not be described in detail.

Based on the same inventive concept, an embodiment of the present invention provides a display apparatus, comprising the above organic electroluminescent display panel provided by the embodiment of the present invention. The display apparatus may be any products or components such as a cellphone, a tablet computer, a television, a display, a notebook computer, a digital photo frame and a navigator, or any device with a display function. Because a principle for solving a problem by the display apparatus is similar to that by the organic electroluminescent display panel, implementations for the display apparatus may refer to that for the organic electroluminescent display panel, and repeated parts will not be re-described in detail.

Based on the same inventive concept, an embodiment of the present invention provides a driving method of a pixel circuit. Because a principle of the driving method is similar to that of the pixel circuit, implementations for the driving method may refer to that for the pixel circuit, and repeated parts will not be re-described in detail.

The embodiments of the present invention provide for a pixel circuit, an organic electroluminescent display panel, a display apparatus and a driving method thereof. The pixel circuit comprises an initialization module, a charging control module, a drive module, and a light emitting module with a light emitting device. In the initialization phase, the initialization module initializes the first node, and the charging control module initializes the third node; in the compensation phase, the light emitting module realizes a conduction between the output end of the drive module and the second reference signal end, the initialization module compensates the threshold voltage of the drive module for the first node; and in the data writing phase, the charging control module performs data writing on the first node through the initialization module. In the light emitting phase, the initialization module realizes a conduction between the first reference signal end and the input end of the drive module, such that the drive module drives the light emitting device in the light emitting module to emit light, thereby realizing a normal light emitting function of the light emitting device. In this way, compared with a pixel circuit in the prior art, the pixel circuit provided by the embodiment of the present invention can perform initialization on the control end of the drive module in the initialization phase, perform compensation on the threshold voltage of the drive module in the compensation phase, and perform data writing on the drive module in the data writing phase, thereby preventing the change in the threshold voltage of the drive module from affecting the luminous brightness of the light emitting device, improving the uniformity of the luminous brightness of the light emitting device, and further ensuring the quality of the display frame.

It will be apparent to those skilled in the art that various modifications and variations may be made to the present invention without departing from the scope or spirit of the present invention. In this way, it is intended that the present invention covers these modifications and variations provided they come within the scope of the appended claims and their equivalents of the present invention.

What is claimed is:

1. A pixel circuit, comprising:

an initialization module;

a charging control module;

a drive module; and a light emitting module with a light emitting device;

a control end of said drive module is connected with a first node, an input end thereof is connected with a second node, and an output end thereof is connected with an input end of said light emitting module;

wherein a control end of said charging control module is connected with a scan signal end, an input end thereof is connected with a data signal end, and an output end thereof is connected with a third node;

wherein said initialization module is connected with said first node, said second node, said third node, a first reference signal end, a first signal control end and said scan signal end;

wherein a first control end of said light emitting module is connected with a second signal control end, a second control end thereof is connected with a light emission signal control end, and an output end thereof is connected with a second reference signal end;

wherein, in an initialization phase, said initialization module is configured to initialize said first node under a control of said scan signal end, and said charging control module is configured to initialize said third node under the control of said scan signal end;

wherein, in a compensation phase, said light emitting module is configured to realize a conduction between an output end of said drive module and said second reference signal end under a control of said second signal control end;

and wherein said initialization module is configured to compensate a threshold voltage of said drive module for said first node under a control of said first signal control end and said scan signal end; and wherein, in a data writing phase, said charging control module is configured to perform data writing on said first node through said initialization module under the control of said scan signal end, wherein said initialization module comprises a first switch transistor, a second switch transistor and a storage capacitor;

wherein a gate electrode of said first switch transistor is connected with said scan signal end, a source electrode thereof is connected with said first reference signal end, and a drain electrode thereof is connected with said first node;

wherein a gate electrode of the second switch transistor is connected with said first signal control end, a source electrode thereof is connected with said first reference signal end, and a drain electrode thereof is connected with said second node; and wherein said storage capacitor is directly connected between the control end of said drive module and the output end of said charging control module, and wherein said light emitting module comprises a light emitting device, a fourth switch transistor and a fifth switch transistor;

wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end;

wherein, in the compensation phase, the second switch transistor receives a high-level signal at the first signal control end, the fourth switch transistor receives a high-level signal at the second signal control end, and the fifth switch transistor receives a low-level signal at the light emission signal control end.

2. The pixel circuit according to claim 1, wherein in a light emitting phase, said initialization module is configured to realize a conduction between said first reference signal end and an input end of said drive module under a control of said first signal control end, such that said drive module drives said light emitting device in said light emitting module to emit light.

3. The pixel circuit according to claim 1, wherein said drive module comprises a drive transistor; and wherein a gate electrode of said drive transistor is connected with said first node, a source electrode thereof is connected with said second node, and a drain electrode thereof is connected with an input end of said light emitting module.

4. The pixel circuit according to claim 1, wherein said charging control module comprises a third switch transistor;

wherein a gate electrode of said third switch transistor is connected with said scan signal end, a source electrode thereof is connected with said data signal end, and a drain electrode thereof is connected with said third node.

5. The pixel circuit according to claim 4, wherein said first switch transistor and said third switch transistor are both P-type transistors, or are both N-type transistors.

6. The pixel circuit according to claim 1, wherein said light emitting module comprises a light emitting device, a fourth switch transistor and a fifth switch transistor, wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end; and wherein a gate electrode of said fifth switch transistor is connected with said light emission signal control end, and a drain electrode thereof is connected with an input end of said light emitting device.

7. An organic electroluminescent display panel, comprising the pixel circuit according to claim 1.

8. A display apparatus, comprising the organic electroluminescent display panel according to claim 7.

9. A driving method of a pixel circuit, wherein said pixel circuit comprises an initialization module, a charging control module, a drive module, and a light emitting module with a light emitting device, wherein a control end of said drive module is connected with a first node, an input end thereof is connected with a second node, and an output end thereof is connected with an input end of said light emitting module; a control end of said charging control module is connected with a scan signal end, an input end thereof is connected with a data signal end, and an output end thereof is connected with a third node; said initialization module is connected with said first node, said second node, said third node, a first reference signal end, a first signal control end and said scan signal end; a first control end of said light emitting module is connected with a second signal control end, a second control end thereof is connected with a light emission signal control end, and an output end thereof is connected with a second reference signal end, wherein said initialization module comprises a first switch transistor, a second switch transistor and a storage capacitor;

wherein a gate electrode of said first switch transistor is connected with said scan signal end, a source electrode thereof is connected with said first reference signal end, and a drain electrode thereof is connected with said first node;

wherein a gate electrode of the second switch transistor is connected with said first signal control end, a source electrode thereof is connected with said first reference signal end, and a drain electrode thereof is connected with said second node; and wherein said storage capacitor is directly connected between the control end of said drive module and the output end of said charging control module;

said method comprising the following steps:

in an initialization phase, initializing said first node by said initialization module under a control of said scan signal end, and initializing said third node by said charging control module under the control of said scan signal end;

in a compensation phase, realizing a conduction between an output end of said drive module and said second reference signal end by said light emitting module under a control of said second signal control end, and compensating a threshold voltage of said drive module for said first node by said initialization module under a control of said first signal control end and said scan signal end; and in a data writing phase, performing data writing on said first node by said charging control module through said initialization module under the control of said scan signal end, and wherein said light emitting module comprises a light emitting device, a fourth switch transistor and a fifth switch transistor;

wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end;

wherein, in the compensation phase, the second switch transistor receives a high-level signal at the first signal control end, the fourth switch transistor receives a high-level signal at the second signal control end, and the fifth switch transistor receives a low-level signal at the light emission signal control end.

10. The method according to claim 9, further comprising:

in a light emitting phase, realizing a conduction between said first reference signal end and an input end of said drive module by said initialization module under a control of said first signal control end, such that said drive module drives said light emitting device in said light emitting module to emit light.

11. The method according to claim 9, wherein said drive module comprises a drive transistor; and wherein a gate electrode of said drive transistor is connected with said first node, a source electrode thereof is connected with said second node, and a drain electrode thereof is connected with an input end of said light emitting module.

12. The method according to claim 9, wherein said charging control module comprises a third switch transistor;

wherein a gate electrode of said third switch transistor is connected with said scan signal end, a source electrode thereof is connected with said data signal end, and a drain electrode thereof is connected with said third node.

13. The method according to claim 12, wherein said first switch transistor and said third switch transistor are N-type transistors.

14. The method according to claim 9, wherein said light emitting module comprises a light emitting device, a fourth switch transistor and a fifth switch transistor, wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end; and wherein a gate electrode of said fifth switch transistor is connected with said light emission signal control end, and a drain electrode thereof is connected with an input end of said light emitting device.

15. A pixel circuit, comprising:

an initialization module;

a charging control module;

a drive module; and a light emitting module with a light emitting device;

a control end of said drive module is connected with a first node, an input end thereof is connected with a second node, and an output end thereof is connected with an input end of said light emitting module;

wherein a control end of said charging control module is connected with a scan signal end, an input end thereof is connected with a data signal end, and an output end thereof is connected with a third node;

wherein said initialization module is connected with said first node, said second node, said third node, a first reference signal end, a first signal control end and said scan signal end;

wherein a first control end of said light emitting module is connected with a second signal control end, a second control end thereof is connected with a light emission signal control end, and an output end thereof is connected with a second reference signal end;

wherein, in an initialization phase, said initialization module is configured to initialize said first node under a control of said scan signal end, and said charging control module is configured to initialize said third node under the control of said scan signal end;

wherein, in a compensation phase, said light emitting module is configured to realize a conduction between an output end of said drive module and said second reference signal end under a control of said second signal control end;

and wherein said initialization module is configured to compensate a threshold voltage of said drive module for said first node under a control of said first signal control end and said scan signal end; and wherein, in a data writing phase, said charging control module is configured to perform data writing on said first node through said initialization module under the control of said scan signal end, wherein said initialization module comprises a first switch transistor, a second switch transistor and a storage capacitor;

wherein a gate electrode of said first switch transistor is connected with said scan signal end, a source electrode thereof is connected with said first reference signal end, and a drain electrode thereof is connected with said first node;

wherein a gate electrode of the second switch transistor is connected with said first signal control end, a source electrode thereof is connected with said first reference signal end, and a drain electrode thereof is connected with said second node; and wherein said storage capacitor is directly connected between the control end of said drive module and the output end of said charging control module, and wherein said light emitting module comprises a light emitting device, a fourth switch transistor and a fifth switch transistor;

wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end;

wherein, in the compensation phase, the second switch transistor receives a low-level signal at the first signal control end, the fourth switch transistor receives a low-level signal at the second signal control end, and the fifth switch transistor receives a high-level signal at the light emission signal control end.

16. The pixel circuit according to claim 15, wherein in a light emitting phase, said initialization module is configured to realize a conduction between said first reference signal end and an input end of said drive module under a control of said first signal control end, such that said drive module drives said light emitting device in said light emitting module to emit light.

17. The pixel circuit according to claim 15, wherein said drive module comprises a drive transistor; and wherein a gate electrode of said drive transistor is connected with said first node, a source electrode thereof is connected with said second node, and a drain electrode thereof is connected with an input end of said light emitting module.

18. The pixel circuit according to claim 15, wherein said charging control module comprises a third switch transistor;

wherein a gate electrode of said third switch transistor is connected with said scan signal end, a source electrode thereof is connected with said data signal end, and a drain electrode thereof is connected with said third node.

19. The pixel circuit according to claim 18, wherein said first switch transistor and said third switch transistor are P-type transistors.

20. The pixel circuit according to claim 15, wherein said light emitting module comprises a light emitting device, a fourth switch transistor and a fifth switch transistor, wherein a gate electrode of said fourth switch transistor is connected with said second signal control end, a source electrode thereof is connected with an output end of said drive module and a source electrode of said fifth switch transistor, and a drain electrode thereof is connected with an output end of said light emitting device and said second reference signal end; and wherein a gate electrode of said fifth switch transistor is connected with said light emission signal control end, and a drain electrode thereof is connected with an input end of said light emitting device.

* * * * *